US007628161B1

(12) United States Patent
LoSauro

(10) Patent No.: US 7,628,161 B1
(45) Date of Patent: Dec. 8, 2009

(54) HAIR-CUTTING AND STYLING DEVICE AND METHOD OF USE

(75) Inventor: Valentino J. LoSauro, N. Ft. Myers, FL (US)

(73) Assignee: Valentino Janna Lo Sauro, N. Ft. Myers, FL (US)

( * ) Notice: Subject to any disclaimer, the term of this patent is extended or adjusted under 35 U.S.C. 154(b) by 1370 days.

(21) Appl. No.: 10/969,973

(22) Filed: Oct. 22, 2004

(51) Int. Cl.
*A45D 7/00* (2006.01)

(52) U.S. Cl. ..... 132/200; 132/213

(58) Field of Classification Search ..... 132/213, 132/214, 200, 212; 30/29.5, 30, 31, 34.2, 30/51, 526, 280, 298, 195, 294; 15/1.52
See application file for complete search history.

(56) References Cited

U.S. PATENT DOCUMENTS 6,112,421 A * 9/2000 Greene ..... 30/526

* cited by examiner

*Primary Examiner*—Robyn Doan
*Assistant Examiner*—Brianne E O'Neill

(57) ABSTRACT

A hair-cutting and styling device comprising a body, a detachable cap and strap, a cutting blade, and a blade clamp. The body consists of a first upper section, second middle section, and third lower section, the first upper and third lower sections disposed angularly in profile. The first upper section contains a depression on one side thereof, first and second opposed elongate slots, and a third slot located between first and second slots. The strap is inserted at opposed ends thereof within respective first and second opposed elongate slots of upper portion of the body so as to create a loop into which the fingertip of a user is inserted. A cap is situated within the depression to assist in securing the strap to the upper portion of the body. A blade is situated within a depression with the cutting edge of the blade extending for some distance beyond bottom side edge of the depression so as to be exposed from within the device for making contact with hair for cutting and styling. A blade clamp is attached to and over the middle section to maintain the blade within the depression of the middle section.

6 Claims, 4 Drawing Sheets

HAIR-CUTTING AND STYLING DEVICE AND METHOD OF USE

BACKGROUND

This version of the invention is concerned with the field of hair-cutting and styling devices. More specifically, this version of the invention is concerned with devices that are clasped onto the fingertip of a user so as to use finger and hand motion of said user to simultaneously cut and style hair.

PRIOR ART

This invention introduces an improved and easier-to-use hand-held device that is used to cut hair and provide the hair with increased body and balance in a style that is pleasing to the recipient of the haircut or hairstyle. Currently, hair stylists trim or cut hair using scissors or electric-powered trimming devices in order to achieve a certain hair length or hairstyle, sometimes layering the hair as they proceed across or over the head of the customer or recipient. Once the cut is achieved, the hair is covered with various gels, solutions, and other treatments to provide a desired texture, thickness, or body, which are enhanced by the use of electrically-powered hair drying devices.

To achieve a desired haircut or hairstyle, hair stylists must inevitably acquire, use, and maintain a variety of such hair-cutting and hair styling instruments and devices. For instance, one or more type of scissors is used to cut hair, and various other tools having at least one sharp edge, typically a razor, are used to layer, shape, or otherwise impart body into a particular hairstyle. Acquisition of such hair-cutting tools and devices involves a considerable up-front expense, and caring for and maintaining such tools and devices over their useful life requires a continuing expenditure of financial resources. Furthermore, the necessity of using such a variety of hair-cutting and styling tools and devices requires the hair stylist to constantly swap such tools during hair-cutting and hair styling, which can unnecessarily burden the hair-cutting and hair styling process in terms of time and expenditure of effort and financial resources.

What is needed then to overcome the disadvantages of separate hair-cutting and styling devices and tools is the provision of a single hair-cutting and styling device that combines the hair-cutting and styling functions of various tools and devices so as to permit a hair stylist or user to perform a variety of hair-cutting and styling tasks without the necessity of acquiring, using, and maintaining an assortment of such tools and devices. The hair-cutting and styling device that is the subject of this version of the invention combines the functions and capabilities of the aforementioned hair-cutting and styling devices and treatments into a single apparatus, albeit an apparatus of several components that require assembly before use, that retains a section of hair for cutting and serves to impart a desired texture and body onto said section of hair.

DISCUSSION OF THE PRIOR ART

The existence of a hair-cutting and styling device designed to accomplish the tasks of the instant invention is unknown at the present time. For example, numerous designs for hair-cutting and styling apparatuses have been provided in the prior art. Even though these designs may be suitable for the specific individual purposes to which they address, they would not be suitable for the purposes of the present version of the invention as such hair-cutting and styling devices are limited in their ability to perform various hair-cutting and styling tasks.

As such, it may be appreciated that there is a continuing need for a new and improved hair-cutting and styling device that provides the means to cut, style, and layer hair and additionally furnish the hair with a certain texture and body. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY

The present version of the invention, which will be described in greater detail hereinafter, relates to the field of hair-cutting and styling devices. More specifically, this version of the invention is concerned with devices that are clasped onto the fingertip of a user so as to use finger and hand motion of said user to simultaneously cut and style hair.

Described briefly, according to a typical embodiment, the invention presents a hair-cutting and styling device that consists of a body, cap, strap, blade, and blade clamp. The body is comprised of an upper section, middle section, and lower section. The upper section is formed partially with a depression or indentation and two flanking slots and a slot situated between the flanking slots, said slots located within said depression. The middle section is comprised of first and second opposed rectangular side members and a rectangular depression, said depression flanked by said side members. A pair of arm members, forming the lower section of the body, extends downwardly from said middle section. A first arm member is connected to and extends downwardly from said first rectangular side member of the middle section, and a second arm member is connected and to extends downwardly from said second rectangular side member of the middle section. Each arm member terminates at a tapered tip or end located distally from connection to respective rectangular side member of the middle section of the body. The arm members, facing each other, enclose a gap or space that extends from the tips or ends of said arm members to the depression of the middle section of the body.

The cap is fabricated with an outer perimeter similar to the boundary of the depression of the upper section of the body and is received within the depression and releasably secured therein by a narrow projection extending from the rear side of the cap that is inserted into the middle slot. The strap is elongate and rectangular in shape and defined by first and second opposed ends. A series of projections with intervening spaces are located at opposed ends of said strap and extend for some distance along said opposed ends of said strap. The blade is constructed of dimensions similar to that of the depression formed within the middle section of the body and is situated within the depression of the middle section of the body. The blade is retained within the depression by a blade clamp, which is snapped over the blade and middle section of the body. The blade clamp consists in part of a front sidewall and opposed lateral sidewalls, which are connected at cooperating ends to opposed ends of said front sidewall. When the blade is secured within the depression of the middle section of the body by said clamp, the cutting edge of said blade extends downwardly for some distance beyond the lower side edge of the depression and bottom side edge of the front sidewall of said blade clamp. As such, the cutting edge of said blade is exposed for cutting and styling hair.

The body, cap, and blade clamp are manufactured of lightweight durable material, such as plastic, hard rubber and the like. The strap is manufactured of lightweight, flexible rubber.

During use, the blade is inserted into the depression of the middle section of the body and secured therein by attaching the blade clamp over the middle section of the body. The strap is secured at both ends to the body by inserting the ends thereof into the flanking slots of the upper section of said body, thus forming a loop. The size of the loop can be adjusted by repositioning the ends of the strap into the flanking slots between any two projections located on opposed ends of the strap. The cap is positioned within the depression of the body and releasably secured thereto once the narrow projection is inserted into the middle slot of the body. Hair-cutting and styling is accomplished by first inserting the fingertip of a finger into the loop formed by the strap once said strap is attached to the body as described previously and then locating the body over a section or strands of hair to be cut or styled. The section of hair to be cut or styled is first gathered within the gap or space enclosed by the arm members extending downwardly from the middle section of the body and then the body is pulled down, rotated in a circular manner, or otherwise manipulated so that the cutting edge of the blade makes contact with hair gathered between the arm members. The amount of pressure exerted by the cutting edge of the blade upon the section of hair is maintained or adjusted so as to control or vary, respectively, the amount of hair being cut or styled once the blade makes contact with the hair.

My invention, therefore, resides not in any one of these features per se, but rather in the particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

Accordingly, it is an object of my version of the invention to provide a low-cost, easy-to-manufacture, and easy-to-market hair-cutting and styling device.

A further object of my version of the invention is to provide an easy-to-use and versatile hair-cutting and styling device.

A significant object of the invention is to provide a hair-cutting and styling device that is comprised of a body, body cap, flexible strap, blade, and blade clamp.

A final but very significant object of the invention is to provide a hair-cutting and styling device that allows a user to simultaneously cut and style hair with the desired body and texture heretofore achieved by a plurality of hair styling instruments and treatments.

For a better understanding of the invention, its operating advantages and the specific objects attained by its uses, reference should be made to the accompanying drawings and descriptive matter in which there is illustrated a preferred embodiment of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention illustrated by the accompanying drawings.

BRIEF DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DRAWING REFERENCE NUMERALS

| | |
|---|---|
| 10 | Hair-Cutting and Styling Device |
| 12 | Body |
| 14 | Upper section of Body |
| 16 | Middle section of Body |
| 18 | Lower section of Body |
| 20 | Depression |
| 22a, b | Lateral Slots |
| 24 | Middle Slot |
| 26a | Side Member |
| 26b | Side Member |
| 28 | Depression |
| 30 | Side Edge |
| 32a | Arm Member |
| 32b | Arm Member |
| 34a | Tip |
| 34b | Tip |
| 36a | Projection |
| 36b | Projection |
| 38 | Gap |
| 40 | Cap |
| 42 | Projection |
| 44 | Strap |
| 46 | End of Strap |
| 48 | End of Strap |
| 50 | Projection |
| 52 | Blade |
| 54 | Cutting Edge of Blade |
| 56 | Blade Clamp |
| 58 | Front Side of Blade Clamp |
| 60a | Lateral Side of Blade Clamp |
| 60b | Lateral Side of Blade Clamp |
| 62 | Indentation of Front Side |
| 64 | Projection |

DESCRIPTION OF THE PREFERRED EMBODIMENT

A detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
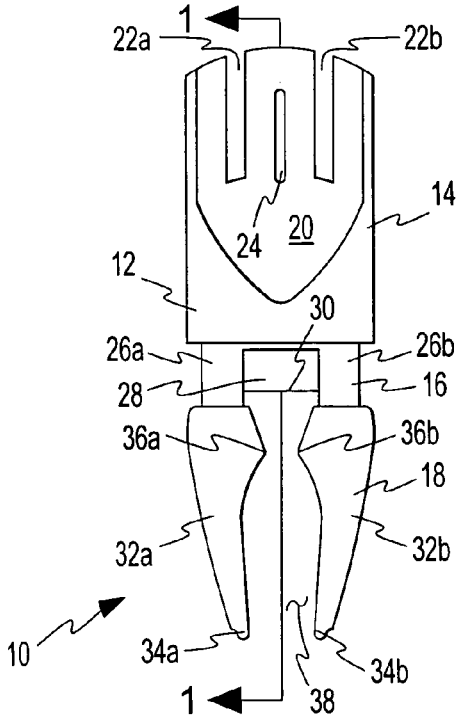
FIG. 1 is a front elevation view of the body of a hair-cutting and styling device in accordance with the present version of the invention.

Referring now to the drawings and, in particular, to FIG. 1 to FIG. 7 wherein there are illustrated a typical embodiment of the hair-cutting and styling device 10. The present version of the invention 10 consists of a one-piece body 12, cap 40, strap 44, blade 52, and blade clamp 56. As illustrated in FIG. 1, the body 12 is generally constructed of an upper section 14, middle section 16, and lower section 18. (In this disclosure, the terms applied to the sections of the body 12, "upper," "middle," and "lower" refer to the orientation of said sections 14, 16, 18 of the body 12 when said device 10 is attached to the finger of a user during intended use of the invention 10.) The upper section 14 on the facing or front side thereof is substantially formed with a hollow, indentation, or depression 20, which extends from the top edge of the upper section 14 and terminates at a tapered end or tip proximate to the bottom edge of the upper section 14. Two narrow end or lateral slots 22*a, b* are located within said depression 20 and are disposed in parallel relation to each other 22*a, b* and to the longitudinal axis of said body 12, said slots 22*a, b* separated from each other 22*a, b* by some distance. The slots 22*a, b* extend downward from the top edge of the upper section 14 to the medial section thereof at which point said slots 22*a, b* terminate. A narrow, elongate middle slot 24 is located medially between the lateral slots 22*a, b* and is disposed in parallel relation therebetween. The middle section 16 of the body 12 is substantially defined by first 26*a* and second 26*b* opposed rectangular side members, said side members 26*a, b* disposed in parallel relation to each other 26*a, b*. The rectangular indentation or depression 28 is defined on the top side thereof by the upper section 14 of the body 12, on opposed lateral sides by said first 26*a* and second 26*b* opposed rectangular lateral side members, and on the bottom side by an exposed side edge 30.

A pair of arm members 32*a, b*, comprising the lower section 18 of the body 12, extends from the middle section 16 for some distance therefrom until they terminate at tapered ends or tips 34*a, b*, respectively. More particularly, a first arm member 32*a* is connected to and extends for some distance from the first, cooperating side member 26*a* of the middle section 16 of the body 12, and a second arm member 32*b* is connected to and extends for some distance from the second, cooperating side member 26*b* of the middle section 16 of the body 12. Each arm member 32*a, b* is slightly curved on interior or facing sides thereof, thereby presenting a concave surface to an opposing arm member 32*a, b*. A projection 36*a, b* is located, respectively, on the interior or facing side of each arm member 32*a, b* proximate to connection of said arm members 32*a, b* to respective side members 26*a, b* of said middle section 16 of said body 12.

As such, a gap 38 or opening is located between the opposed arm members 32*a, b* with said gap 38 having maximum width or distance between respective tips 34*a, b* of said arm members 32*a, b* and, conversely, said gap 38 having minimum width or distance between respective projections 36*a, b* of said arm members 32*a, b*. The arm members 32*a, b* thus enclose a gap 38 or space into which a section of hair is situated for cutting and styling. The gap 38 is segmented into a first, majority section roughly corresponding to the area located between respective tips 34*a, b* and projections 36*a, b* of said arm members 32*a, b* and a second, minority section roughly corresponding to the area located between respective projections 36*a, b* of said arm members 32*a, b* and lower side edge 30 of depression 28 of said middle section 16. The inside or facing surfaces of said arm members 32*a, b* taper from minimum width or distance at respective projections 36*a, b* to a greater width or distance at connection of said arm members 32*a, b* to respective side members 26*a, b* of said middle section 16.

Figure 2:
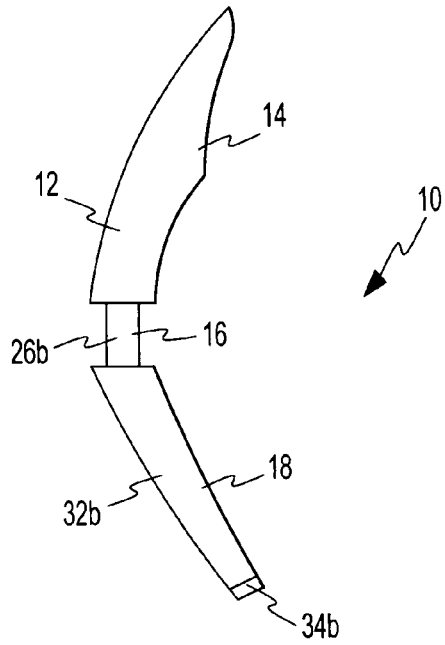
FIG. 2 is a side elevation view of the body of a hair-cutting and styling device according to line 1-1 of FIG. 2.

As shown in FIG. 2, the body 12 presents an angled profile with the upper section 14 and lower section 18 disposed at X angle with respect to each other 14, 18.

Figure 3:
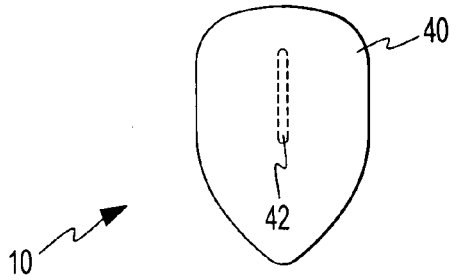
FIG. 3 is a front elevation view of a body cap in accordance with the present version of the invention.

Referring to FIG. 3, therein illustrated is the cap 40, which is designed for insertion into the depression 20 of the upper section 14 of the body 12. As such, the cap 40 is constructed with an outer perimeter similar to that of the depression 20. The cap 40 is also fitted on one side thereof with a narrow, elongate projection 42 that can be inserted in frictional engagement into the middle slot 24 of the upper section 14 of the body 12.

Figure 4:
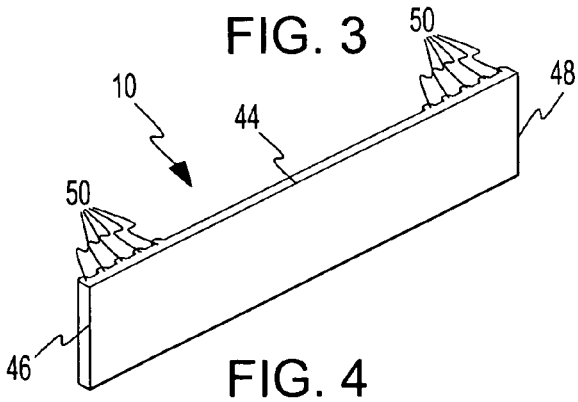
FIG. 4 is a perspective view of a strap in accordance with the present version of the invention.

The strap 44, illustrated in FIG. 4, is elongate and rectangular having first 46 and second 48 opposed narrow ends. A series of elongate projections 50 with each projection 50 having a semi-circular profile is affixed, attached to, or otherwise formed onto the strap 44 on the same side thereof adjacent to the narrower ends 46, 48. The projections 50 are separated from each other 50 by intervening spaces.

Figure 5:
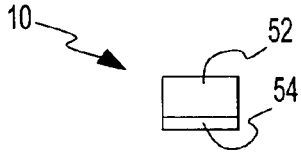
FIG. 5 is a front elevation view of a blade in accordance with the present version of the invention.
Figure 6:
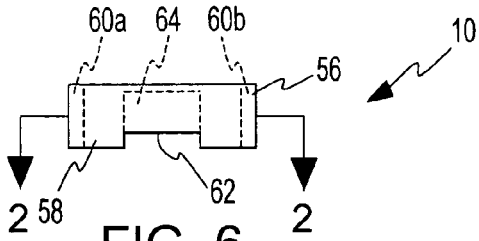
FIG. 6 is a front elevation view of a clamp for blade in accordance with the present version of the invention.
Figure 7:
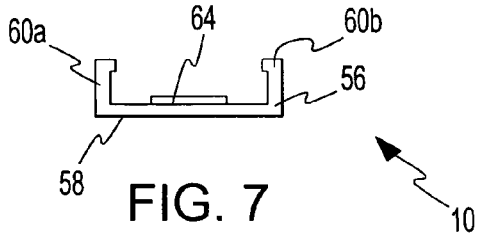
FIG. 7 is a top plan view of a clamp for blade according to line 2-2 of FIG. 6.

The blade 52, which is shown in FIG. 5, is constructed into a rectangular shape with a cutting edge 54 and an outer perimeter similar to that of the depression 28 of the middle section 16 of the body 12. In this manner, the blade 52 can be inserted within the depression 28 in firm engagement with the edge of the blade 54 extending for some distance beyond the bottom side edge 30 of the depression 28 of the middle section 16. The blade 52 is retained within the depression 28 by the blade clamp 56, which is illustrated in FIG. 6 and FIG. 7. The blade clamp 56 is comprised of a front sidewall 58 and first 60*a* and second 60*b* opposed lateral sidewalls, said lateral sidewalls 60*a, b* maintained in parallel relation to each other 60*a, b* and in perpendicular disposition to that of the front sidewall 58. An indentation 62 is located on bottom side of the front sidewall 58, said indentation 62 sufficient to allow exposure of the blade 52 cutting edge 54 when said blade clamp 56 is attached to the middle section 16 of the body 12 over the blade 52. A rectangular projection 64 is located on the interior side of the front sidewall 58. The projection 64 extends from the rear of the sidewall 58 for a distance commensurate with the depth of the depression 28 of the middle section 16 of the body 12 and possesses a perimeter similar to that of said depression 28. More particularly, the projection 64 occupies the space of the depression 28 not occupied by the blade 52 when said blade 52 is situated in said depression 28 and said blade clamp 56 is attached to said middle section 16 of body 12 over said blade 50.

The body 12, cap 40, and blade clamp 56 are manufactured of lightweight, durable, material that is rigid yet possessing a degree of flexibility, such as plastic, hard rubber, various composite materials, and the like. The strap 44 is fabricated of flexible, durable material such as rubber and the like.

Figure 8:
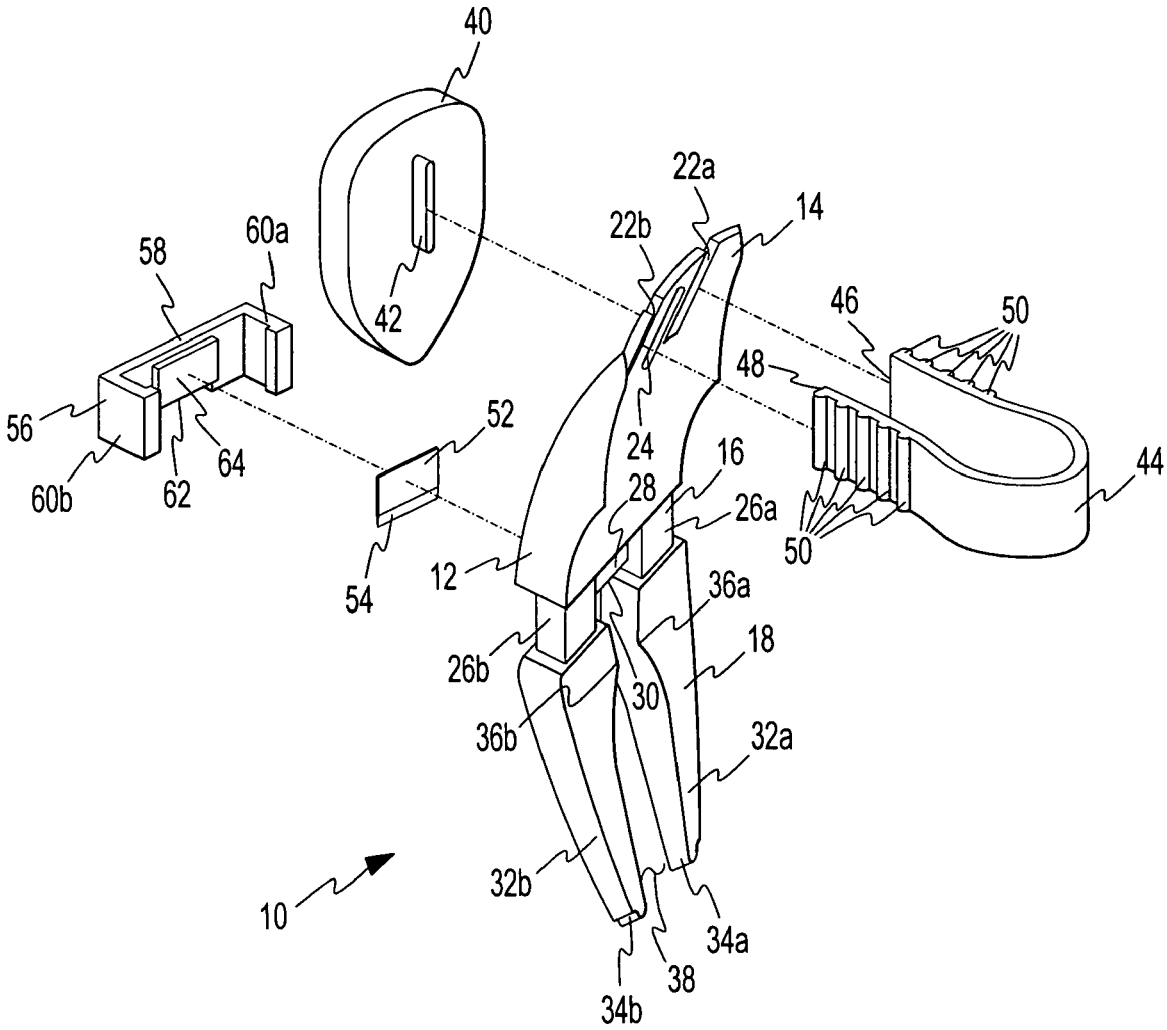
FIG. 8 is a rear perspective view of the components of a hair-cutting and styling device aligned for assembly.
Figure 9:
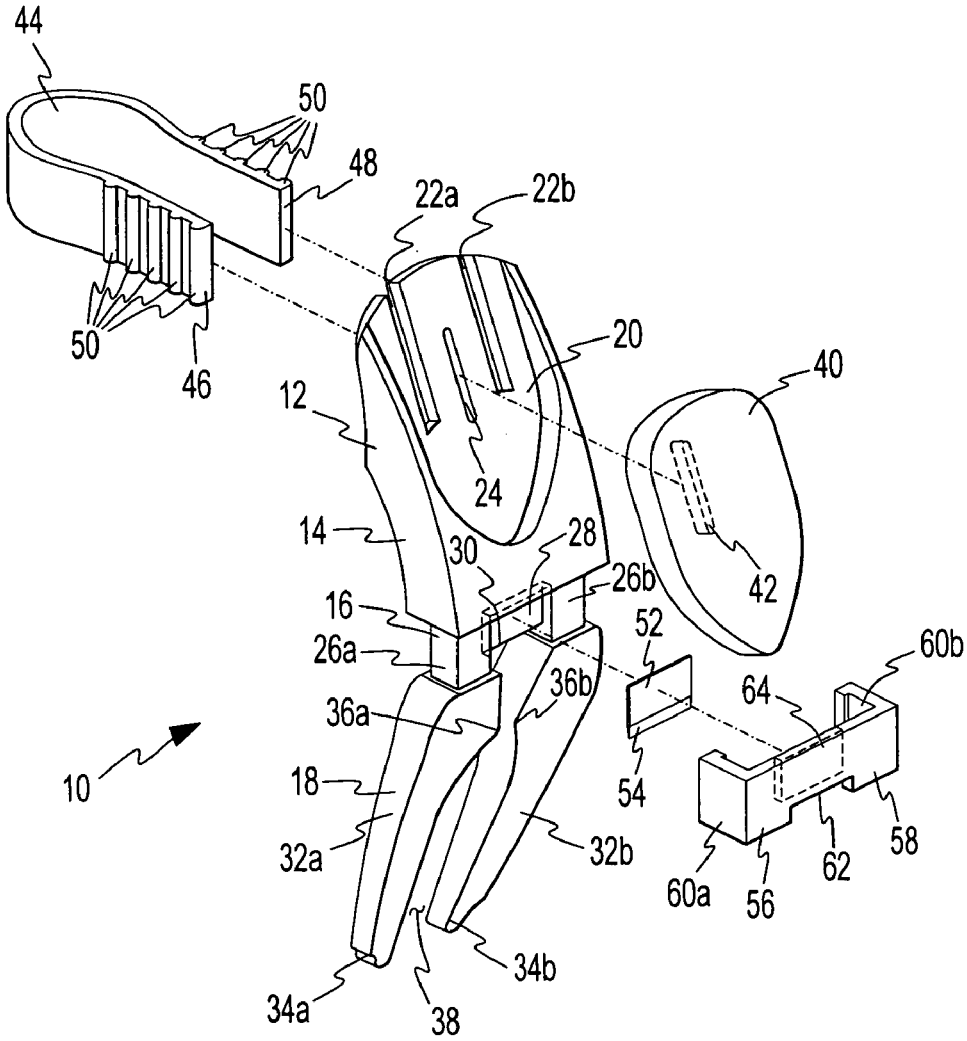
FIG. 9 is a front perspective view of the components of a hair-cutting and styling device aligned for assembly.

In FIGS. 8 and 9, the body 12, cap 40, strap 44, blade 52, and blade clamp 56 are aligned for assembly. The strap 44 can be releasably secured to the upper section 14 of the body 12 by pressing the ends 46, 48 thereof into the respective slots 22*a, b* between any two adjacent projections 50. The cap 40 is inserted into the depression 20 of the upper section 14 of the body 12 and secured thereto by pressing the projection 42 into the cooperating middle slot 24 of the body 12. Once secured to the body 12, the cap 40 covers the ends 46, 48 of the strap 44 extending beyond the slots 22*a, b*, thereby anchoring the strap 44 to the body 12. The blade 52 is inserted into the depression 28 of the middle section 16 of the body 12 with the cutting edge 54 down and extending somewhat beyond the bottom side edge 30 of said depression 28. The blade 52 is secured therein by placing the blade clamp 56 over the front side of the middle section 16 and blade 52, ensuring that the sides 60*a, b* engage and lock around respective side members 26*a, b* of the middle section 16. The cutting edge 54 of the blade 52 extends downwardly beyond the edge of the indentation 62 on front side 58 of said blade clamp 56.

During use, the body 12 with the aforementioned components 40, 44, 52, 56 attached thereon is pulled downward over a section of hair for cutting and styling of said hair.

Figure 10:
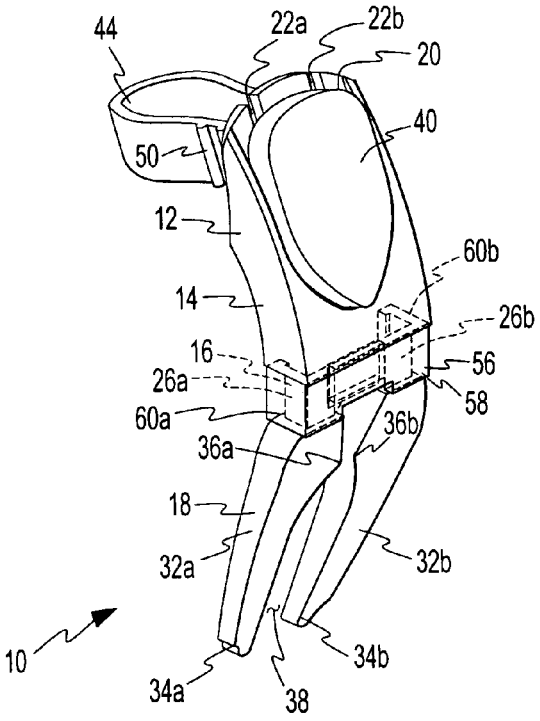
FIG. 10 is a front perspective view of a hair-cutting and styling device in an assembled configuration.
Figure 11:
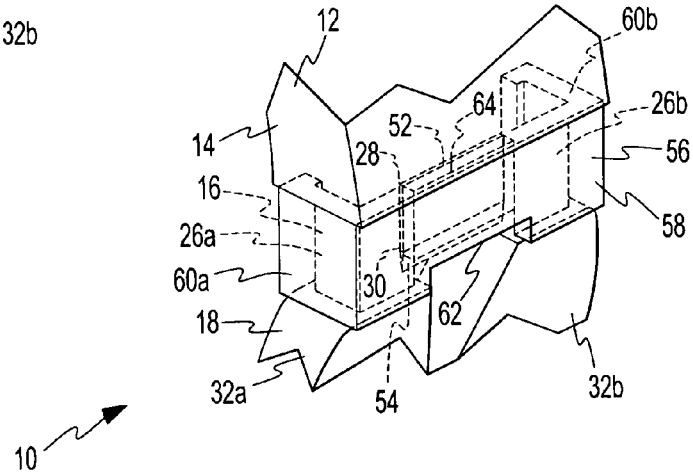
FIG. 11 is a front perspective view of a hair-cutting and styling device illustrating in detail the blade clamp and blade of said device in an assembled configuration.

The hair-cutting and styling device 10 is illustrated as fully assembled in FIG. 10 with the cap 40 attached to the upper section 14 of the body 12 as described previously and assisting in securing opposed ends 46, 48 of the strap 44 within respective lateral slots 22*a, b* of the upper section 14 of the body 12. In this manner, the strap 44 in conjunction with the rear side of the upper section 14 of the body 12 is configured as a closed loop into which the fingertip of user can be inserted to manipulate the device 10 for hair-cutting and styling. As necessary, the size of the loop created by attachment of opposed end 46, 48 the strap 44 to the lateral slots 22*a, b* can be adjusted by inserting said opposed ends 46, 48 of the strap 44 within respective lateral slots 22*a, b* at various locations between cooperating projections 50 of opposed ends 46, 48 of said strap 44. The blade clamp 56 is attached to and over the middle section 16 of the body 12, and, more particularly, over the depression 28 thereof, thereby securing the blade 52 within the depression 28. As shown in detail in FIG. 11, the blade 52 (shown in phantom line) occupies the depression 28 and is held therein by the projection 64 (phantom line) of the blade clamp 56 occupying the section of the depression 28 not occupied by the blade 52 when said blade 52 is situated in said depression 28 and urging against said blade 52, thereby preventing said blade 52 from becoming dislodged, removed, dislocated, or otherwise separated from the depression 28. The blade 52 is further assisted in remaining within the depression 28 and therein at the proper alignment by the top sides of the arms 32*a, b* at connection to respective side members 26*a, b* of the middle section 16, said opposed ends of cutting edge 54 of blade 52 making slight contact with top sides of said arms 32*a, b* and prevented from sliding out of said depression 28 over the bottom side edge 30 thereof. As shown in detail, the cutting edge 54 of the blade 52 extends slightly beyond and below the bottom side edge 30 of the depression 28 and bottom sides of the indentation 62 and projection 64 located below and behind, respectively, the front side wall 58 of the blade clamp 56. As such, the cutting edge 54 of the blade 52 is sufficiently exposed to cut hair once said hair is gathered between the arm members 32*a, b* and directed therein towards said cutting edge 54 of the blade 52.

Method of Use

Cutting and styling of hair is accomplished first by inserting a finger (not shown) at the fingertip thereof into the looped strap 44 as referenced previously, ensuring that the strap 44 is adjusted as necessary to retain the device 10 on the fingertip of the user. The device 10 can be used with any one of the four fingers of either hand of a user. In any event, the device 10 when attached to a finger is manipulated by a combination of movement of the forearm at the elbow, the hand at the wrist, and the finger at knuckles thereof. More particularly, the device 10, as it is attached directly to the fingertip of a user, follows most precisely the pivoting motion of said finger at one or more associated knuckles, thereby imparting direct and precise cutting and styling action desired by the user. A section of hair (not shown) to be cut or styled is initially gathered within the arms 32*a, b* at respective tips 34*a, b* thereof and eventually into the gap 38 enclosed or defined by said arms 32*a, b*. The section of hair is directed away from said respective tips 34*a, b* and towards the projections 36*a, b* either by action of the fingertip upon which the device 10 is attached or by pulling the section of hair at a free end thereof with the other hand. As the hair reaches the projections 36*a, b*, said projections 36*a, b* function to compress or reduce the volume of said section of hair at which point, said section of hair, continuing along its initial path away from said respective tips 34*a, b*, is delivered into the area generally located between respective projections 36*a, b* of said arm members 32*a, b* and lower side edge 30 of depression 28 of said middle section 16. At this point, the device 10 can be manipulated in at least four methods to accomplish various haircutting and styling objectives. In a first method, the device 10 is moved in a circular motion over the hair situated between the arm members 32*a, b* at high speed and striking the hair occasionally with the cutting edge 54 of the blade 52 to fluff or expand the volume of the hair. In a second method, the device 10 is used primarily to cut or shear the hair at a particular location or length by striking directly and forcefully the hair with the cutting edge 54 of the blade 52. In a third method, the device 10 is used to thatch or feather the hair, striking the hair with the cutting edge 54 of the blade 52 at different locations along the length of the hair. In a fourth method, a small section of hair is twisted and inserted into the gap 38 between the arm members 32*a, b* and then cutting or shearing said section of hair with a quick snap of the knuckle or wrist so as to create a spike, fringes, and accents in the hair. Of course, other cutting and styling methods can be accomplished with the hair-cutting and styling device 10 only limited by the imagination, facility, and experience of the user.

While this version of the invention has been illustrated and described in detail in the drawings and foregoing description, the same is to be considered as illustrative and not restrictive in character, it being understood that only the preferred embodiment has been shown and described and that all changes and modifications that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

CONCLUSION AND SCOPE OF INVENTION

From the foregoing, it will be understood by persons skilled in the art that an improved hair-cutting and styling device has been provided. The invention is relatively simple and easy to manufacture, yet affords a variety of uses. While my description contains many specificities, these should not be construed as limitations on the scope of the version of the invention, but rather as an exemplification of the preferred embodiment thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as defined by the appended claims.

What is claimed is:

1. A hair-cutting and styling device comprising:

a body, said body having a first upper section, second middle section, and third lower section, said upper and lower sections disposed angularly relative to each other in profile, said upper section of body enclosing on a front side thereof a depression with first and second opposed elongate slots located within said depression and a third slot located between said first and second opposed elongate slots, said slots disposed in parallel relation to each other and along the longitudinal axis of said body, said middle section of body defined by first and second opposed side members, said side members enclosing a depression on the front side of said middle section, said lower section of body consisting of first and second opposed arm members connected to respective first and second opposed side members of said middle section of body and extending away from said side members for some distance, said arm members terminating at tapered ends and enclosing a space there between from point of connection at said first and second opposed side members to said tapered ends, said space having a greatest distance between the tapered ends of said arm members and least distance between opposed projections located on facing sides of said arm members, said space for receiving and gathering hair to be cut and styled at said tapered ends thereof; a flexible strap, said flexible strap having first and second opposed ends with a series of projections that are separated by intervening spaces and extending for some distance along first and second opposed ends along the same side of said strap, said strap releasably secured to said body at the upper section of said body by inserting first and second opposed ends of said strap into the respective first and second lateral slots of upper section between any two projections thereof at each of the first and second opposed ends of said strap so as to create an adjustable loop for inserting a finger of a user in order to manipulate the device; a detachable cap, said cap having an outer perimeter similar to the boundary of said depression along the upper section of said body and further having a narrow, elongate projection extending from one side of said cap, said projection having an outer perimeter similar to-boundary of said middle slot of said upper section of said body, said cap detachably secured to said upper section of said body by means of said projection inserted into said middle slot and frictionally engaging sidewalls of said middle slot of said upper section of said body; a blade located within the depression on the front side of said middle section with the cutting edge of said blade extending for some distance beyond the lower side edge of said depression, said cutting edge making contact with top sides of the arm members at the connection point of said arm members to the respective side members of said middle section; and a blade clamp having a front sidewall and first and second opposed lateral sidewalls connected at first ends thereof to the opposed ends of said front sidewall, said front sidewall having a rectangular indentation located medially along a lower side edge thereof and a rectangular projection extending for some distance from the rear of said front sidewall, said blade clamp located over the middle section of said body and detachably secured thereto by means of said lateral sidewalls thereof frictionally engaging said first and second opposed side members of said middle section with said rectangular projection thereof partially occupying said depression of middle section and urging against said blade located therein, retaining said blade within said depression, said cutting edge of blade extending for some distance beyond the rectangular indentation of said front sidewall for making contact with hair by said hair gathered at tapered ends of said arm members and directed by finger action controlling said device towards said cutting edge of blade for cutting and styling of said hair.

2. A method for cutting and styling hair with a hair-cutting and styling device, as claimed in claim 1 said method comprising the steps of:

a) inserting a finger at the fingertip thereof into the looped strap of said device, ensuring that said strap is adjusted as necessary to retain the device on the fingertip of the user and pivoting said finger at one or more knuckles to control and manipulate said device;

b) gathering a section of hair to be cut or styled within the arms of said device at respective tips thereof and eventually into the gap enclosed or defined by said arms, directing said section of hair away from said respective tips and towards the projections of said arms either by action of the fingertip upon which the device is attached or by pulling the section of hair at a free end thereof with other hand;

c) compressing or reducing volume of hair upon reaching said projections; and d) delivering hair into area generally located between respective projections of said arm members, lower side edge of depression of said middle section, indentation of front sidewall of blade clamp, and cutting edge of blade.

3. The method according to claim 2, further comprising rotating the device in a circular motion over said hair situated between said arm members at high speed and striking said hair occasionally with the cutting edge of said blade to fluff or expand the volume of the hair.

4. The method according to claim 2, further comprising cutting said hair at a particular location or length by striking directly and forcefully said hair with the cutting edge of said blade.

5. The method according to claim 2, further comprising striking the hair with the cutting edge of said blade at different locations along the length of said hair to feather said hair.

6. The method according to claim 2, further comprising twisting a small section of hair and inserting said section of hair into the gap between said arm members and cutting or shearing said section of hair with a quick snap of the knuckle or wrist so as to create a spike, fringes, and accents in the hair.

* * * * *